US009042557B2

(12) United States Patent
Seo et al.

(10) Patent No.: US 9,042,557 B2
(45) Date of Patent: May 26, 2015

(54) METHOD AND APPARATUS FOR REPRODUCING THREE-DIMENSIONAL SOUND FIELD

(75) Inventors: Jeong Il Seo, Daejeon (KR); Jae Hyoun Yoo, Daejeon (KR); Kyeong Ok Kang, Daejeon (KR); Min Cheol Shin, Southampton (GB); Filippo M Fazi, Southampton (GB); Philip A. Nelson, Southampton (GB)

(73) Assignee: Electronics and Telecommunications Research Institute, Daejeon (KR)

( * ) Notice: Subject to any disclaimer, the term of this patent is extended or adjusted under 35 U.S.C. 154(b) by 379 days.

(21) Appl. No.: 13/452,260

(22) Filed: Apr. 20, 2012

(65) Prior Publication Data

US 2012/0269349 A1 Oct. 25, 2012

Related U.S. Application Data

(60) Provisional application No. 61/477,280, filed on Apr. 20, 2011.

(30) Foreign Application Priority Data

Aug. 23, 2011 (KR) ..... 10-2011-0084014

(51) Int. Cl.

| | |
|---|---|
| ***H04R 5/00*** | (2006.01) |
| ***H04S 1/00*** | (2006.01) |
| ***G10H 1/32*** | (2006.01) |
| ***H04R 7/04*** | (2006.01) |
| ***H04S 5/02*** | (2006.01) |
| ***H04S 3/00*** | (2006.01) |

(52) U.S. Cl.
CPC ..... *H04S 3/006* (2013.01)

(58) Field of Classification Search
USPC ..... 381/17, 56, 58, 61, 300, 307, 309, 310
See application file for complete search history.

(56) References Cited

U.S. PATENT DOCUMENTS

| | | | | |
|---|---|---|---|---|
| 2009/0046864 | A1* | 2/2009 | Mahabub et al. | 381/17 |
| 2009/0097668 | A1* | 4/2009 | Kim et al. | 381/71.1 |

FOREIGN PATENT DOCUMENTS

| | | | |
|---|---|---|---|
| JP | 2007-158731 | A | 6/2007 |
| KR | 1020090037691 | A | 4/2009 |

* cited by examiner

*Primary Examiner* — Duc Nguyen
*Assistant Examiner* — Yogeshkumar Patel
(74) *Attorney, Agent, or Firm* — William Park & Assoicates Ltd.

(57) ABSTRACT

Provided is a method and apparatus for reproducing a three-dimensional (3D) sound field. A method of reproducing a 3D sound field may determine a control region based on a wavelength of an excitation frequency, set, based on a loudspeaker array, at least one candidate control point in the control region, and determine a non-uniform control point corresponding to a non-uniform loudspeaker.

14 Claims, 6 Drawing Sheets

METHOD AND APPARATUS FOR REPRODUCING THREE-DIMENSIONAL SOUND FIELD

CROSS-REFERENCE TO RELATED APPLICATION

This application claims the benefit of U.S. Application No. 61/477,280, filed Apr. 20, 2011 in United States Patent Trademark Office, and Korean Patent Application No. 10-2011-0084014, filed on Aug. 23, 2011, in the Korean Intellectual Property Office, the disclosure of which is incorporated herein by reference.

BACKGROUND

1. Field of the Invention

The present invention relates to a method and apparatus for reproducing a three-dimensional (3D) sound field, in particular, to a method and apparatus for reproducing a 3D sound field, adaptively, to a loudspeaker array.

2. Description of the Related Art

Nowadays, with development of a three-dimensional television (3DTV) and an ultra-high definition television (UHDTV), a technology for reproducing a 3D sound field is commanding attention.

In general, a 3D sound field may be reproduced using a multiple loudspeaker array. When a multiple loudspeaker array is used, a loud speaker array system may include a plurality of continuous sound sources, or may include a plurality of uniformly distributed discrete sound sources.

In particular, a conventional apparatus for reproducing a 2D sound field such as a 5.1 channel speaker, a 7.1 channel speaker, and the like, and a conventional apparatus for reproducing a 3D sound field such as a 10.2 channel speaker, a 12.2 channel speaker, a 22.2 channel speaker, and the like may use a non-uniformly distributed loudspeaker array.

However, when a loudspeaker array is non-uniformly distributed, a conventional method of reproducing a sound field may involve an apparatus for reproducing a sound field that is unstable and has a degraded localization performance.

Accordingly, there is a desire for a technology that stably reproduces a sound field, irrespective of a distribution of a loudspeaker array.

SUMMARY

An aspect of the present invention provides an apparatus and method for reproducing a three-dimensional (3D) sound field that may stably reproduce a sound field when a loudspeaker array is non-uniform.

According to an aspect of the present invention, there is provided a method of reproducing a 3D sound field, the method including determining a control region based on a wavelength of an excitation frequency, setting, based on a loudspeaker array, at least one candidate control point in the control region, determining, from the at least one candidate control point, a non-uniform control point corresponding to a non-uniform loudspeaker, and determining whether to add the non-uniform control point to a control point.

The determining whether to add the non-uniform control point to the control point may include determining whether to add the non-uniform control point to the control point based on an angle between a non-uniform unit vector corresponding to the non-uniform control point and a target unit vector corresponding to a target control point, and adding the non-uniform control point to the control point in response to the non-uniform control point being determined to be added to the control point.

The determining of the non-uniform control point may include determining the non-uniform control point based on an inner product of a candidate unit vector corresponding to the at least one candidate control point and a target unit vector corresponding to the target control point.

The determining of the control region may include calculating a radius based on the wavelength of the excitation frequency, and determining, to be the control region, a virtual control sphere generated based on the radius.

The setting of the at least one candidate control point may include setting the at least one candidate control point at a point where a virtual line, connecting a center of the control sphere and the loudspeaker array, intersects a boundary of the control sphere.

The method may further include generating a control point matrix using the non-uniform control point, and calculating a cost function based on the control point matrix, a transfer function, a pressure of a reproduced sound field, and a pressure of a target sound field.

The method may further include calculating a magnitude of a non-uniform unit vector corresponding to the non-uniform control point based on the transfer function, the pressure of the target sound field, and the control point matrix.

According to another aspect of the present invention, there is provided an apparatus for reproducing a 3D sound field, the apparatus including a control region determining unit to determine a control region based on a wavelength of an excitation frequency, a setting unit to set, based on a loudspeaker array, at least one candidate control point in the control region, and a control point determining unit to determine, from the at least one candidate control point, a non-uniform control point corresponding to a non-uniform loudspeaker.

The control point determining unit may determine whether to add the non-uniform control point to the control point based on an angle between a non-uniform unit vector corresponding to the non-uniform control point and a target unit vector corresponding to a target control point.

The control point determining unit may determine the non-uniform control point based on an inner product of a candidate unit vector corresponding to the at least one candidate control point and a target unit vector corresponding to the target control point.

The control region determining unit may calculate a radius based on the wavelength of the excitation frequency, and determine a virtual control sphere generated based on the radius to be the control region.

The setting unit may set the at least one candidate control point at a point where a virtual line, connecting a center of the control sphere and the loudspeaker array, intersects a boundary of the control sphere.

The apparatus may further include a calculator to generate a control point matrix using the non-uniform control point, and to calculate a cost function based on the control point matrix, a transfer function, a pressure of a reproduced sound field, and a pressure of a target sound field.

The calculator may calculate a magnitude of a non-uniform unit vector corresponding to the non-uniform control point based on the transfer function, the pressure of the target sound field, and the control point matrix.

According to an embodiment of the present invention, there is provided a method of reproducing a 3D sound field that may accurately and stably reproduce a sound field irrespective of a distribution of a loudspeaker array by reproducing a sound field based on a non-uniform control point corresponding to a non-uniform loudspeaker in a loudspeaker array.

According to another embodiment of the present invention, there is provided a method of reproducing a 3D sound field that may enhance a robustness of an apparatus for reproducing a 3D sound field by evenly distributing energy of a magnitude of a sound source.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
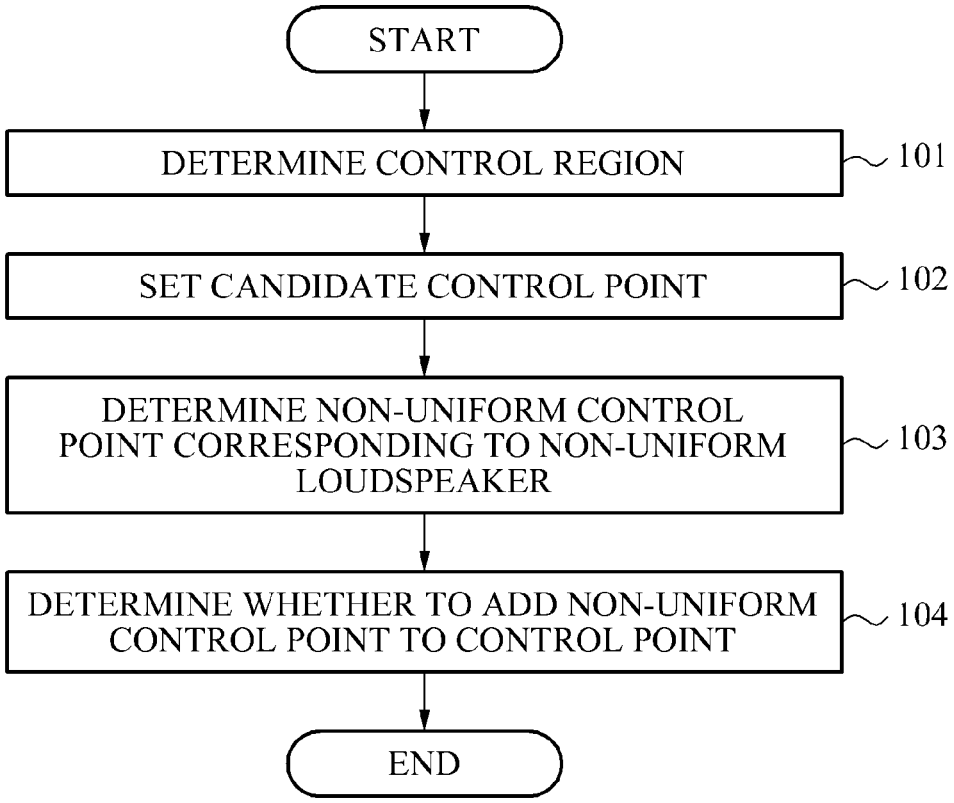
FIG. 1 is a flowchart illustrating a method of determining a non-uniform control point in an apparatus for reproducing a three-dimensional (3D) sound field according to embodiments of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a flowchart illustrating a method of determining a non-uniform control point in an apparatus for reproducing a three-dimensional (3D) sound field according to embodiments of the present invention.

Referring to FIG. 1, in operation 101, an apparatus for reproducing a 3D sound field may determine a control region for controlling a reproduction of a sound field based on a wavelength of an excitation frequency.

For example, the apparatus for reproducing a 3D sound field may determine a radius of a control sphere based on a wavelength of an excitation frequency. The apparatus for reproducing a 3D sound field may generate a virtual control sphere based on the determined radius. Then, the apparatus for reproducing a 3D sound field may determine a region on an inside of the virtual control sphere to be the control region. In this instance, a plurality of loudspeakers may be disposed in a circular configuration around the virtual control sphere.

In operation 102, the apparatus for reproducing a 3D sound field may set, based on a loudspeaker array, candidate control points in the control region. In this instance, a number of the candidate control points may be less than or equal to a number of loudspeakers included in the loudspeaker array.

For example, the apparatus for reproducing a 3D sound field may virtually connect a center of the control sphere to the plurality of loudspeakers. The apparatus for reproducing a 3D sound field may set the candidate control points at points where virtual lines, connecting the center of the control sphere and the plurality of loudspeakers, intersect a boundary of the control sphere. Setting the candidate control points at points on the boundary of the control sphere will be further described with reference to FIG. 2.

In operation 103, the apparatus for reproducing a 3D sound field may determine a non-uniform control point from the candidate control points. Here, the non-uniform control point may be a candidate control point corresponding to a non-uniform loudspeaker that non-uniformly distributes among the plurality of loudspeakers disposed around the control sphere.

For example, the apparatus for reproducing a 3D sound field may determine, from among the candidate control points, the non-uniform control point based on an inner product of a candidate unit vector corresponding to each candidate control point and a target unit vector corresponding to a target control point. Here, the target control point may correspond to a point where a virtual line, connecting the center of the control sphere and a target sound field, intersects the boundary of the control sphere. The target unit vector may correspond to a vector indicating a direction from the center of the control sphere to a point where a target sound field enters the control sphere.

In operation 104, the apparatus for reproducing a 3D sound field may determine whether to add the non-uniform control point to a control point.

In this instance, the apparatus for reproducing a 3D sound field may determine whether to add the non-uniform control point to the control point based on an angle between a unit vector corresponding to the non-uniform control point and a target unit vector.

For example, the apparatus for reproducing a 3D sound field may calculate an angle between a unit vector corresponding to the non-uniform control point and a target unit vector. When the angle is less than or equal to a reference angle $\alpha$, the apparatus for reproducing a 3D sound field may add the non-uniform control point to the control point. In this instance, when the angle is greater than the reference angle $\alpha$, the apparatus for reproducing a 3D sound field may not add the non-uniform control point to the control point.

The apparatus for reproducing a 3D sound field may add, to the control point, candidate points excluding the non-uniform control point among the candidate control points.

Figure 2:
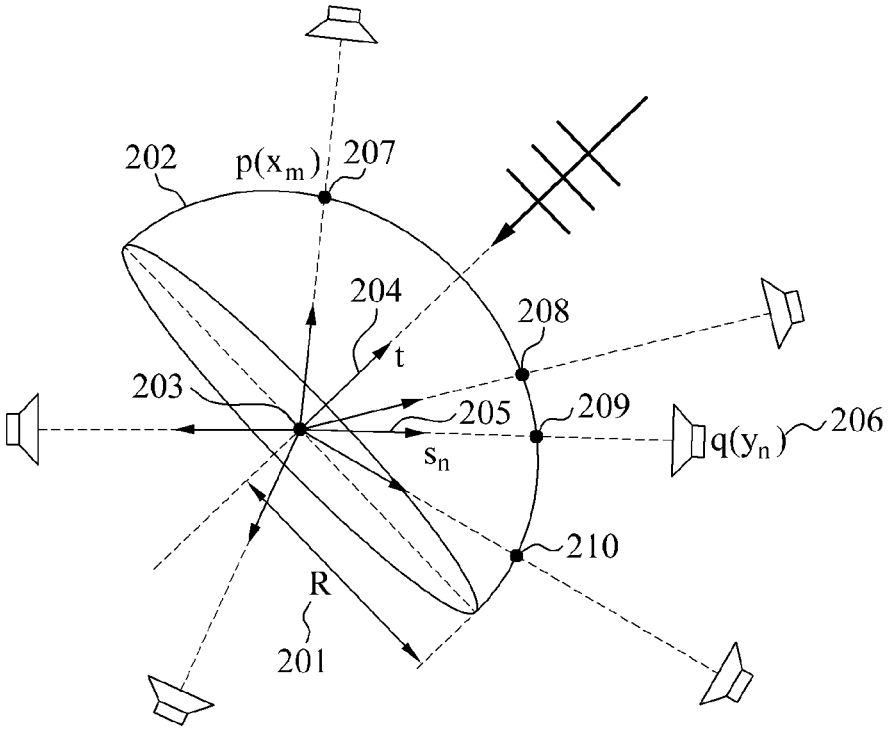
FIG. 2 is a diagram illustrating a control region determined in an apparatus for reproducing a 3D sound field according to embodiments of the present invention.

FIG. 2 is a diagram illustrating a control region determined in an apparatus for reproducing a 3D sound field according to embodiments of the present invention.

Referring to FIG. 2, an apparatus for reproducing a 3D sound field may generate a virtual control sphere 202 using a radius R 201 of a control sphere that is calculated based on a wavelength of an excitation frequency. In this instance, a plurality of loudspeakers may be disposed in a circle around the control sphere 202.

The apparatus for reproducing a 3D sound field may virtually connect a center 203 of the control sphere 202 and the plurality of loudspeakers, and set candidate control points (1 through 4) 207 through 210 at points where a virtual line, connecting the center 203 of the control sphere 202 and the plurality of loudspeakers, intersect a boundary of the control sphere 202.

The apparatus for reproducing a 3D sound field may determine a non-uniform control point among candidate control points. In this instance, the apparatus for reproducing a 3D sound field may determine at least one non-uniform control point among candidate control points based on an inner product of a target unit vector t 204 and a candidate unit vector.

For example, the apparatus for reproducing a 3D sound field may determine, to be the non-uniform control point, a candidate control point corresponding to a candidate unit vector when an inner product of the candidate unit vector and a target unit vector is greater than or equal to a reference inner product. For example, when the reference inner product corresponds to "0," the apparatus for reproducing a 3D sound field may calculate an inner product of the target unit vector t 204 and a candidate unit vector (3) 205 corresponding to the candidate control point (3) 209. When the calculated inner product corresponds to "0," the apparatus for reproducing a 3D sound field may determine, to be the non-uniform control point, the candidate control point (3) 209 corresponding to the candidate unit vector (3) 205. Here, the target unit vector t 204 may correspond to a vector indicating a direction from the center 203 of the control sphere 202 to a point where a target sound field enters the control sphere 202. The candidate unit vector (3) 205 may correspond to a vector indicating a direction from the center 203 of the control sphere 202 to a location yn of a non-uniform loudspeaker 206. When a virtual line connects the center 203 of the control sphere 202 to the target sound field, a target control point may correspond to a point where the virtual line intersects the boundary of the control sphere 202.

In a similar scheme, the apparatus for reproducing a 3D sound field may determine the non-uniform control point by calculating an inner product of the target unit vector t 204 and each candidate unit vector set on the boundary of the control sphere 202. In this instance, when an inner product of the target unit vector t 204 and a candidate unit vector (2) corresponding to the candidate control point (2) 208 is less than a reference inner product, the apparatus for reproducing a 3D sound field may determine that the candidate control point (2) 208 does not correspond to the non-uniform control point.

Figure 3:
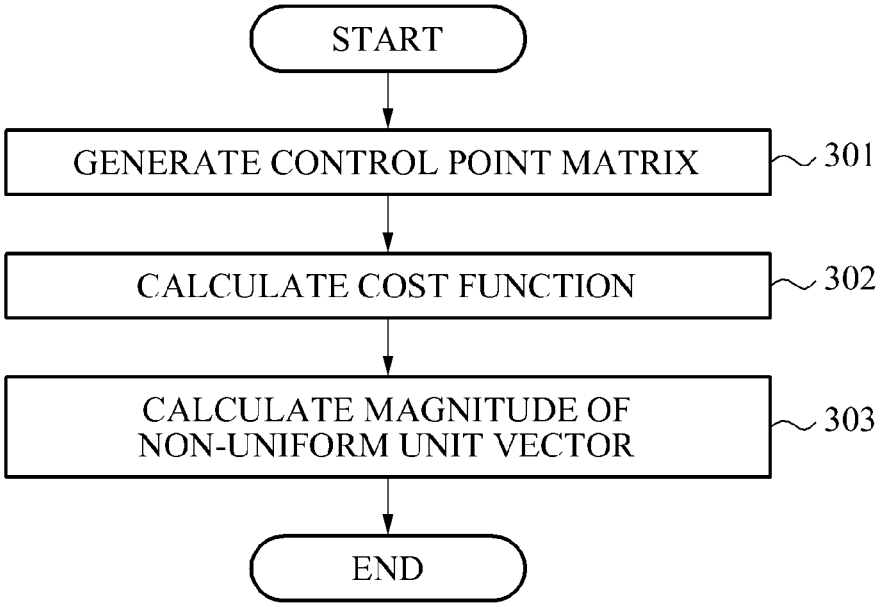
FIG. 3 is a flowchart illustrating a method of calculating a magnitude of a non-uniform unit vector in an apparatus for reproducing a 3D sound field according to embodiments of the present invention.

FIG. 3 is a flowchart illustrating a method of calculating a magnitude of a non-uniform unit vector in an apparatus for reproducing a 3D sound field according to embodiments of the present invention.

Referring to FIG. 3, in operation 301, an apparatus for reproducing a 3D sound field may generate a control point matrix Γ using a non-uniform control point.

For example, the control point matrix Γ may correspond to a diagonal matrix including non-uniform control points as shown in Equation 1.

$$\Gamma = \begin{bmatrix} 1 & 0 & 0 & 0 & 0 \\ 0 & \gamma_1(\varphi_1) & 0 & 0 & 0 \\ 0 & 0 & \gamma_2(\varphi_2) & 0 & 0 \\ 0 & 0 & 0 & \ddots & 0 \\ 0 & 0 & 0 & 0 & \gamma_N(\varphi_N) \end{bmatrix} \quad \text{[Equation 1]}$$

In Equation 1, when an inner product of a candidate unit vector $S_n$ and a target unit vector t is greater than or equal to "0," that is, when $\cos\phi_n=(s_n\cdot t)/(|s_n||t|)\geq 0$ is satisfied, $\gamma_n(\phi_n)=1$. Here, $\gamma_n(\phi_n)$ may correspond to a parameter used for selecting a control point. $\gamma_n(\phi_n)$ may be used for informing whether to select a control point at an $n^{th}$ control point $\phi_n$. For example, when $\gamma_n(\phi_n)$ is expressed by $$\gamma_n(\varphi_n) = \begin{cases} 0 & \cos(\varphi_n) < 0 \\ 1 & \cos(\varphi_n) \geqq 0 \end{cases},$$

$\gamma_n(\phi_n)$ may inform whether to select a control point by returning a value of "0" or "1."

In operation 302, the apparatus for reproducing a 3D sound field may calculate a cost function based on a control point matrix, a transfer function, a pressure of a reproduced sound field, and a pressure of a target sound field. For example, the apparatus for reproducing a 3D sound field may calculate a cost function $J_a$ using Equation 2.

$$J_a=\|\Gamma(p-\hat{p})\|^2=\|\Gamma(p-Zq)\|^2 \quad \text{[Equation 2]}$$

In Equation 2, Γ denotes a control point matrix, p denotes a pressure matrix of a target sound field, $\hat{p}$ denotes a pressure matrix of a reproduced sound field, Z denotes a transfer function, and q denotes a magnitude of a non-uniform unit vector. Here, p may correspond to a matrix $p=[p_0\, p_1\, p_2 \ldots p_N]^T$ including a pressure value $p_0$ at a center of a control sphere and pressure values $p_n(n-1, 2, \ldots, N)$ at each candidate control point set on a boundary of the control sphere.

As shown in Equation 2, the apparatus for reproducing a 3D sound field may minimize the cost function by calculating the cost function using the control point matrix.

In operation 303, the apparatus for reproducing a 3D sound field may calculate a magnitude $q_a$ of a non-uniform unit vector based on a cost function, a pressure of a target sound field, and a control point matrix. For example, the apparatus for reproducing a 3D sound field may calculate the magnitude $q_a$ of the non-uniform unit vector using Equation 3.

$$q_a=(Z^H\Gamma^2Z)^{-1}(Z^H\Gamma)p=(\Gamma Z)^+p \quad \text{[Equation 3]}$$

In Equation 3, $Z^H$ denotes a Hermitian transpose matrix of a transfer function Z, and an operator $(\ )^+$ denotes a Moore-Penrose pseudoinverse using a singular value decomposition (SVD).

As described in the foregoing, the apparatus for reproducing a 3D sound field may evenly distribute a total sound source energy over an overall frequency by calculating the magnitude $q_a$ of the non-uniform unit vector based on the control point matrix.

Figure 4:
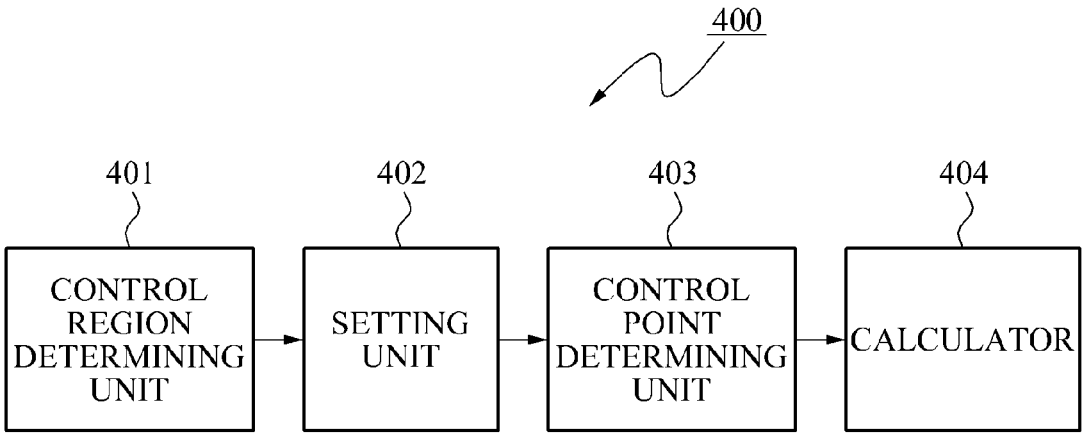
FIG. 4 is a block diagram illustrating a configuration of an apparatus for reproducing a 3D sound field according to embodiments of the present invention.

FIG. 4 is a block diagram illustrating a configuration of an apparatus for reproducing a 3D sound field according to embodiments of the present invention.

Referring to FIG. 4, an apparatus for reproducing a 3D sound field 400 may include a control region determining unit 401, a setting unit 402, a control point determining unit 403, and a calculator 404.

For example, the control region determining unit 401 may calculate a radius R of a control sphere based on a wavelength of an excitation frequency. The control region determining unit 401 may generate a virtual control sphere based on the radius R of the control sphere. The control region determining unit 401 may determine, to be a control region, a region from a center of the control sphere to a boundary of the control sphere. For example, a listener may be located at the center of the control sphere. In this instance, a plurality of loudspeakers may be distributed in a circular configuration around the control sphere.

The setting unit 402 may set, based on a loudspeaker array, at least one candidate control point in the control region. The setting unit 402 may set a candidate control point corresponding to each loudspeaker on the boundary of the control sphere using the plurality of loudspeakers disposed in a circular configuration around the control sphere.

For example, the setting unit 402 may virtually connect the center of the control sphere to the plurality of loudspeakers, and may set candidate control points corresponding to each loudspeaker at points where the virtually connected line intersects the boundary of the control sphere.

The control point determining unit 403 may determine a non-uniform control point corresponding to a non-uniform loudspeaker among the candidate control points set on the boundary of the control sphere.

In this instance, the control point determining unit 403 may determine the non-uniform control point among the candidate control points based on an inner product of a candidate unit vector corresponding to each candidate control point and a target unit vector corresponding to a target control point. Here, the target control point may correspond to a point where a virtual line, connecting the center of the control sphere and a target sound field, intersects the boundary of the control sphere. The target unit vector may correspond to a vector indicating a direction from the center of the control sphere to a point where a target sound field enters the control sphere.

For example, the control point determining unit 403 may calculate an inner product of the candidate unit vector and the target unit vector. The control point determining unit 403 may compare the calculated inner product with a reference inner product. In this instance, when the calculated inner product is greater than or equal to the reference inner product, the control point determining unit 403 may determine the candidate control point corresponding to the candidate unit vector to be the non-uniform control point.

The control point determining unit 403 may determine whether to add the non-uniform control point to the control point based on an angle between a non-uniform unit vector and the target unit vector.

For example, the control point determining unit 403 may calculate the angle between the non-uniform unit vector and the target unit vector. The control point determining unit 403 may compare the calculated angle with a reference angle. For example, when the calculated angle is less than or equal to the reference angle, the control point determining unit 403 may add the non-uniform control point to the control point. In this instance, when the calculated angle is greater than the reference angle, the control point determining unit 403 may not add the non-uniform control point to the control point.

The calculator 404 may generate a control point matrix using the non-uniform control point. In this instance, the calculator 404 may generate a control point matrix using the non-uniform unit vector corresponding to the non-uniform control point determined to be added to the control point. For example, the calculator 404 may generate the control point matrix based on Equation 1.

The calculator 404 may calculate a cost function $J_a$ based on a control point matrix $\Gamma$, a transfer function Z, a pressure of a reproduced sound field $\hat{p}$, a pressure of a target sound field p. For example, the calculator 404 may calculate the cost function $J_a$ based on Equation 2. The calculator 404 may minimize the cost function by calculating the cost function using the control point matrix.

The calculator 404 may calculate a magnitude $q_a$ of a non-uniform unit vector based on a transfer function Z, a pressure of a target sound field p, and a control point matrix $\Gamma$. For example, the calculator 404 may calculate a magnitude $q_a$ of a non-uniform unit vector based on Equation 3.

Figure 5:
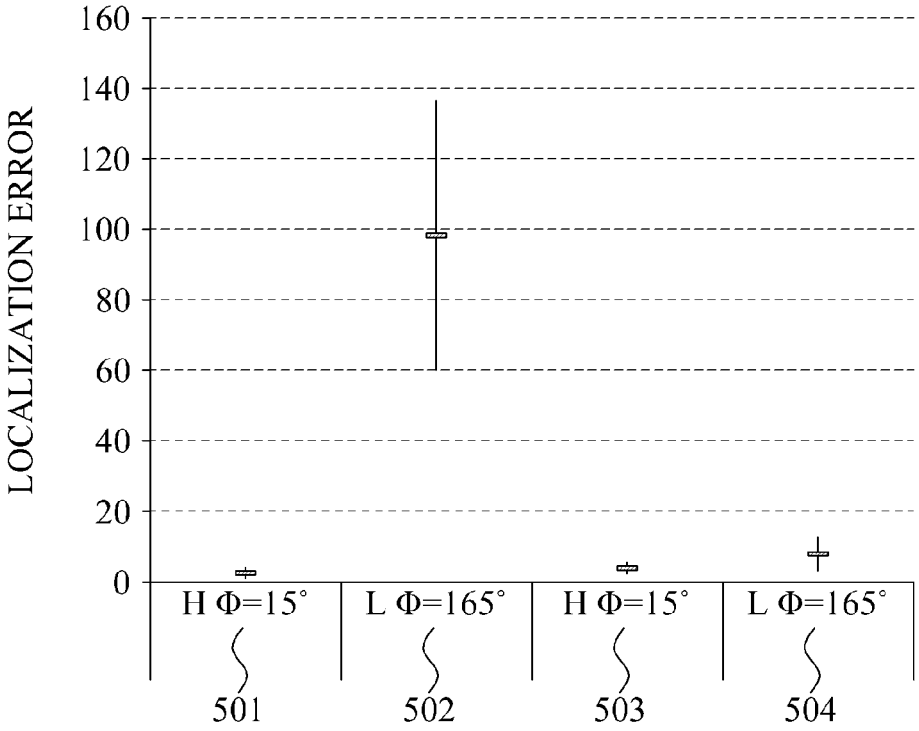
FIG. 5 is a diagram illustrating a horizontal angular error of an apparatus for reproducing a 3D sound field according to embodiments of the present invention.

FIG. 5 is a diagram illustrating a horizontal angular error of an apparatus for reproducing a 3D sound field according to embodiments of the present invention. Referring to FIG. 5, a horizontal angular error may be obtained from results of a listening evaluation conducted for a listener group.

Figure 6:
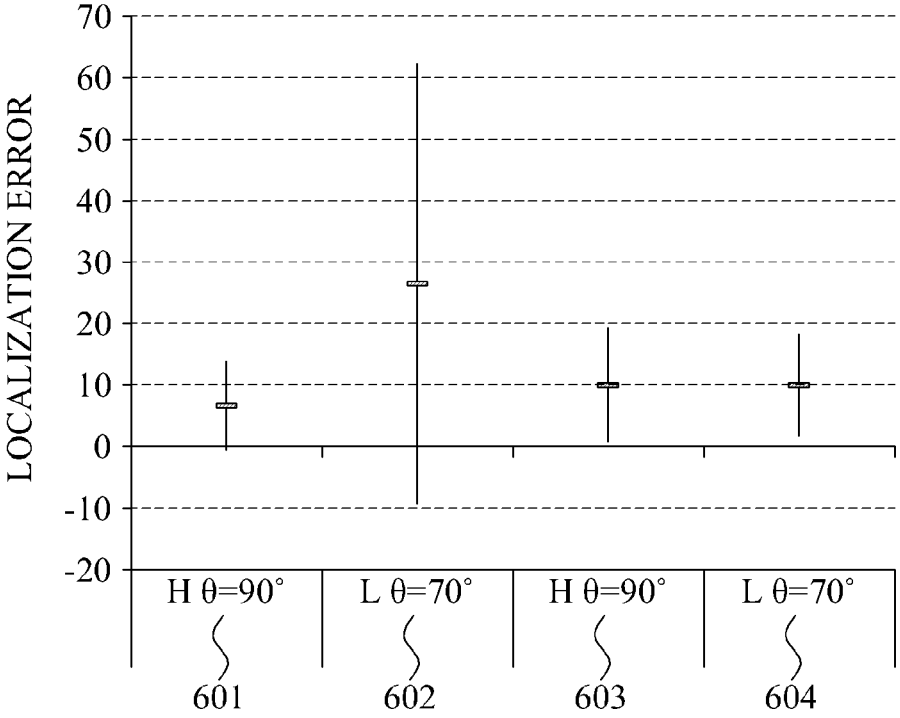
FIG. 6 is a diagram illustrating a vertical angular error of an apparatus for reproducing a 3D sound field according to embodiments of the present invention.

FIG. 6 is a diagram illustrating a vertical angular error of an apparatus for reproducing a 3D sound field according to embodiments of the present invention. Referring to FIG. 6, a vertical angular error may be obtained from results of a listening evaluation conducted for a listener group.

In particular, FIG. 5 and FIG. 6 illustrate an error in a case where a 3D sound field is reproduced using a least squares regression compared to an error of an apparatus for reproducing a 3D sound field according to embodiments of the present invention when loudspeakers are distributed in a high density H and when loudspeakers are distributed in a low density L in a 10.2 channel environment.

Referring to FIG. 5, when loudspeakers are distributed in a high density H, both of a horizontal angular error 501 in a case where a least squares regression is used, and a horizontal angular error 503 of the apparatus for reproducing a 3D sound field is near "0." Referring to FIG. 6, when loudspeakers are distributed in a high density H, a vertical angular error 601 in a case where a least squares regression used is similar to a vertical angular error 603 of the apparatus for reproducing a 3D sound field.

However, referring to FIG. 5, when loudspeakers are distributed in a low density L, a horizontal angular error 502 in a case where a least squares regression used is relatively great, and a horizontal angular error 504 of the apparatus for reproducing a 3D sound field is near "0." Referring to FIG. 6, when loudspeakers are distributed in a high density H, a vertical angular error 602 in a case where a least square is used is relatively significant, and a vertical angular error 604 of the apparatus for reproducing a 3D sound field is similar to a vertical angular error when loudspeakers are distributed in a high density H.

As described in the foregoing, when loudspeakers are distributed in a low density and a sound field is reproduced using a least squares regression, a vertical angular error and a horizontal angular error may be significantly great and thus, a listener may not recognize a reproduced virtual sound. However, when a sound field is reproduced using the apparatus for reproducing a 3D sound field, a vertical angular error and a horizontal angular error may be significantly low for a case where loudspeakers are distributed in a low density as well as a case where loudspeakers are distributed in a high density and thus, a stable and accurate sound may be provided to a listener.

The above-described exemplary embodiments of the present invention may be recorded in non-transitory computer-readable media including program instructions to implement various operations embodied by a computer. The media may also include, alone or in combination with the program instructions, data files, data structures, and the like.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A method of reproducing a three-dimensional (3D) sound field, the method comprising:

determining a control region based on a wavelength of an excitation frequency;

setting, based on a loudspeaker array, at least one candidate control point in the control region;

determining, from the at least one candidate control point, a non-uniform control point corresponding to a non-uniform loudspeaker; and determining whether to add the non-uniform control point to a control point.

2. The method of claim 1, wherein the determining whether to add the non-uniform control point to the control point comprises:

determining whether to add the non-uniform control point to the control point based on an angle between a non-uniform unit vector corresponding to the non-uniform control point and a target unit vector corresponding to a target control point; and adding the non-uniform control point to the control point in response to the non-uniform control point being determined to be added to the control point.

3. The method of claim 1, wherein the determining of the non-uniform control point comprises determining the non-uniform control point based on an inner product of a candidate unit vector corresponding to the at least one candidate control point and a target unit vector corresponding to the target control point.

4. The method of claim 1, wherein the determining of the control region comprises:

calculating a radius based on the wavelength of the excitation frequency; and determining, to be the control region, a virtual control sphere generated based on the radius.

5. The method of claim 4, wherein the setting of the at least one candidate control point comprises setting the at least one candidate control point at a point where a virtual line, connecting a center of the control sphere and the loudspeaker array, intersects a boundary of the control sphere.

6. The method of claim 1, further comprising:

generating a control point matrix using the non-uniform control point; and calculating a cost function based on the control point matrix, a transfer function, a pressure of a reproduced sound field, and a pressure of a target sound field.

7. The method of claim 6, further comprising:

calculating a magnitude of a non-uniform unit vector corresponding to the non-uniform control point based on the transfer function, the pressure of the target sound field, and the control point matrix.

8. An apparatus for reproducing a three-dimensional (3D) sound field, the apparatus comprising:

a control region determining unit to determine a control region based on a wavelength of an excitation frequency;

a setting unit to set, based on a loudspeaker array, at least one candidate control point in the control region; and a control point determining unit to determine, from the at least one candidate control point, a non-uniform control point corresponding to a non-uniform loudspeaker.

9. The apparatus of claim 8, wherein the control point determining unit determines whether to add the non-uniform control point to the control point based on an angle between a non-uniform unit vector corresponding to the non-uniform control point and a target unit vector corresponding to a target control point.

10. The apparatus of claim 8, wherein the control point determining unit determines the non-uniform control point based on an inner product of a candidate unit vector corresponding to the at least one candidate control point and a target unit vector corresponding to the target control point.

11. The apparatus of claim 8, wherein the control region determining unit calculates a radius based on the wavelength of the excitation frequency, and determines a virtual control sphere generated based on the radius to be the control region.

12. The apparatus of claim 11, wherein the setting unit sets the at least one candidate control point at a point where a virtual line, connecting a center of the control sphere and the loudspeaker array, intersects a boundary of the control sphere.

13. The apparatus of claim 8, further comprising:

a calculator to generate a control point matrix using the non-uniform control point, and to calculate a cost function based on the control point matrix, a transfer function, a pressure of a reproduced sound field, and a pressure of a target sound field.

14. The apparatus of claim 13, wherein the calculator calculates a magnitude of a non-uniform unit vector corresponding to the non-uniform control point based on the transfer function, the pressure of the target sound field, and the control point matrix.

* * * * *